US005338470A

United States Patent [19]

Hiebert et al.

[11] Patent Number: 5,338,470

[45] Date of Patent: Aug. 16, 1994

[54] ALKYLATED CITRIC ACID ADDUCTS AS ANTIWEAR AND FRICTION MODIFYING ADDITIVES

[75] Inventors: John Hiebert, Bensalem, Pa.; Carleton N. Rowe, Wenonah; Leslie R. Rudnick, Lawrenceville, both of N.J.

[73] Assignee: Mobil Oil Corporation, Fairfax, Va.

[21] Appl. No.: 988,493

[22] Filed: Dec. 10, 1992

[51] Int. Cl.[5] ..... C10M 145/22; C10M 149/00

[52] U.S. Cl. ..... 252/51.5 A; 252/56 R

[58] Field of Search ..... 560/180; 564/138, 153; 252/56 R, 51.5 A

[56] References Cited

U.S. PATENT DOCUMENTS

| | | | |
|---|---|---|---|
| 3,826,675 | 7/1974 | Smith et al. | 252/56 R |
| 3,950,397 | 4/1976 | Batelaan | 560/180 |
| 4,761,482 | 8/1988 | Karol | 548/142 |
| 4,866,202 | 9/1989 | Weil | 560/180 |
| 4,871,375 | 10/1989 | Martischius et al. | 44/71 |
| 4,892,967 | 1/1990 | Hull et al. | 560/180 |
| 5,049,699 | 9/1991 | Kotick | 560/180 |
| 5,145,593 | 9/1992 | Takashima | 252/56 R |

FOREIGN PATENT DOCUMENTS

| | | | |
|---|---|---|---|
| 1022336 | 1/1989 | Japan | 560/180 |
| 959412 | 6/1964 | United Kingdom | 560/180 |

*Primary Examiner*—Ellen M. McAvoy
*Attorney, Agent, or Firm*—Alexander J. McKillop; George W. Hager, Jr.; Charles A. Malone

[57] ABSTRACT

Alkylated citric acid derivatives obtained as a reaction product of citric acid and an alkyl alcohol or an amine have been found to be effective antiwear and friction modifying additives for fuels and lubricants.

7 Claims, No Drawings

ALKYLATED CITRIC ACID ADDUCTS AS ANTIWEAR AND FRICTION MODIFYING ADDITIVES

FIELD OF THE INVENTION

This invention is directed to additives which have been found to be effective antiwear and friction modifying additives for fuels and lubricants. More specifically it is directed to alkylated citric acid derivatives.

BACKGROUND OF THE INVENTION

Lubricants, such as lubricating oils and greases are subject to oxidative deterioration at elevated temperatures or upon prolonged exposure to the elements. Such deterioration is evidenced, in many instances, by an increase in acidity and viscosity. It can cause metal parts to corrode. Additionally, severe oxidation leads to a loss of lubrication properties which results in the wear of metal parts.

It is known that sliding or rubbing metal or other solid surfaces are subject to wear under conditions of extreme pressure. Wearing is particularly acute in modern engines in which high temperatures and contact pressures are prevalent.

Friction is also a problem any time two surfaces are in sliding or rubbing contact. It is especially significant in an internal combustion engine and power transmission systems, because loss of a substantial amount of the theoretical mileage possible from a gallon of fuel is traceable directly to friction.

Another serious problem in respect to metallic surfaces in contact with adjacent metallic surfaces is the surface wear caused by the contact of such surfaces. The need for improving lubricity via friction modifying additives and prevention of wear by antiwear additives for lubricating oils to meet the ever changing requirements of modern engines is clearly well known. One material capable of simultaneously and effectively coping with these serious problems is highly desirous.

Martischius et al. in U.S. Pat. No. 4,871,375 that issued on Oct. 3, 1989 discloses fuels for Otto engines containing small proportions of an alkali-metal or alkaline-earth metal salts of amic acids where partial amides of tricarboxylic acids such as citric acids are utilized.

Therefore, what is needed is an alkylated carboxylic acid which can be used in the absence of an alkali-metal or alkaline-earth metal salt of amic acids to impart synergistic antiwear and friction modifying properties to lubricants and fuels.

SUMMARY OF THE INVENTION

The present invention is directed to lubricant and fuel compositions comprised of liquid fuels, or oils of lubricating viscosity, and greases prepared therefrom containing minor amounts of highly effective antiwear additive products prepared by reacting citric acid with alkyl alcohols and amines to form alkylated citric acid adducts. This invention is also directed to the reaction products themselves and to a process for making said products.

Accordingly, it is an object of this invention to provide improved fuel and lubricant compositions and more specifically antiwear fuel and lubricant compositions.

It is another object of this invention to provide for alkylated citric acid adducts which additionally provide cleanliness, antioxidant, extreme pressure, antifatigue, and high temperature stabilizing properties to fuels, lubricants, and greases.

It is a further object of this invention to provide for alkylated citric acid adducts that reduce pollution, as measured by carbon monoxide, $NO_x$ emissions, and/or soot when said adducts are added to fuels.

It is a yet further object of this invention to provide for alkylated citric acid adducts which show good compatibility when used in the presence of other commonly used additives in fuel and lubricant compositions.

BRIEF DESCRIPTION OF PREFERRED EMBODIMENTS

In the practice of this invention, citric acid is reacted with alkyl alcohols and amines to form alkylated citric acid adducts. These adducts are obtained by the reaction as shown below.

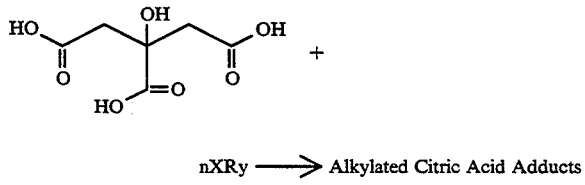

Where R is $C_{1-200}$ hydrocarbyl or hydrocarbylene or a mixture thereof, and may optionally contain oxygen, nitrogen or sulfur.

"X" is an amine, alcohol, thiol or a metal amide, alkoxide or thiolate. The metal is preferentially sodium, potassium, or calcium and "n" is a number from 0.2–5.0.

The reaction proceeds at a pressure of ambient or above, a temperature of from about 100° to about 350° C., or reflux, for a time sufficient to complete the reaction or until a desired volume of water has been collected. As is preferred, the time will be from about 0.2 to about 48 hours and the temperature will be from 100° to about 220° C. The reaction products are allowed to cool to a temperature of less than about 100° C. Afterwards, volatile components are removed by vacuum distillation and a clear light brown liquid alkylated citric acid adduct reaction product or additive is obtained. The obtained additive is then placed into a fuel or lubricant composition. Fuel compositions containing small additive concentrations of alkylated citric acid adducts possess excellent antiwear and friction modifying qualities to said composition. These additives are believed to impart additional cleanliness, antioxidant, extreme pressure, antifatigue, and high temperature stabilizing properties to the fuel compositions. Both the citric acid and alkyl groups are believed to provide the basis for the synergistic antiwear and friction modifying properties of these novel additives. These additives can also be used in internal engine combustion lubricant compositions to provide many similar properties thereto.

All of these beneficial properties are believed to be the result of this novel synergism. These additive products or adducts display good compatibility when used in the presence of other commonly used additives in fuel and lubricant compositions. When they are used in fuels, reduced pollution, as measured by hydrocarbon, carbon monoxide, and $NO_x$ emissions are believed to be obtained.

Alkylated carboxylic acids, alkylated dimer acids, and alkylated glycol and polyols improve the antiwear activity of lubricant and fuel compositions. These novel alkylated citric acid derivatives, having an increased number of acid/ester functions, a potential alcohol/olefin function, and an alkyl tail, provide excellent antiwear activity in lubricants and fuels, which is likely due to the increased surface activity of the additive. This unique synergism regarding antiwear is believed due to further esterification and/or polymerization on the rubbing surfaces to form higher molecular weight species. This polymeric surface film reduces metal-metal contact, and thus wear.

The additives may be incorporated into any suitable lubricating media. One media includes liquid hydrocarbon fuels, such as the petroleum based fuels, i.e. gasoline, kerosene and heavier fuel oils. All of these may require extreme pressure/antiwear activity, thermal stability and/or friction protection.

It is expected that these materials would also be suitable for use in liquid hydrocarbyl or alcoholic or mixed hydrocarbyl/alcoholic or oxygenated fuel compositions. They are utilized in fuels in amounts of from about 5 to 500 pounds of additive per thousand barrels of fuel and preferably from about 5 to about 250 pounds per 1,000 barrels of fuel.

The fuels contemplated are liquid hydrocarbon combustion fuels, including oxygenated and alcoholic fuels as well as distillate fuels and fuel oils. Accordingly, the fuel oils that may be improved in accordance with the present invention are hydrocarbon fractions having an initial boiling point of at least about 250° F. and an end-boiling point no higher than about 750° F. and boiling substantially continuously throughout their distillation range. Such fuel oils are generally known as distillate fuels oils. It is to be understood, however, that this term is not restricted to straight run distillate fractions. The distillate fuel oils can be straight run distillate fuel oils, catalytically or thermally cracked (including hydrocracked) distillate fuel oils, or mixtures of straight run distillate fuel oils, naphthas and the like, with cracked distillate stocks. Moreover, such fuel oils can be treated in accordance with well-known commercial methods, such as, acid or caustic treatment, hydrogenation, solvent refining, clay treatment, etc.

The distillate fuel oils are characterized by their relatively low viscosities, pour points, and the like. The principal property which characterizes the contemplated hydrocarbons, however, is the distillation range. As mentioned herein before, this range will lie between about 250° F. and about 750° F. Obviously, the distillation range of each individual fuel oil will cover a narrower boiling range falling, nevertheless, within the above-specified limits. Likewise, each fuel oil will boil substantially continuously throughout its distillation range.

Contemplated among the fuel oils are Nos. 1, 2 and 3 fuel oils used in heating and as diesel fuel oils, and the jet combustion fuels. The domestic fuel oils generally conform to the specification set forth in A.S.T.M. Specification D396-48T. Specifications for diesel fuels are defined in A.S.T.M. Specification D975-48T, Typical jet fuels are defined in Military Specification MIL-F-5624B.

Other media comprise oils of lubricating viscosity, e.g., mineral, vegetable, or synthetic; or mixtures of mineral and synthetic or greases in which the aforementioned oils are employed as a vehicle or into such functional fluids as hydraulic fluids, brake fluids, power transmission fluids and the like. In general, mineral oils, vegetable, and/or synthetic, employed as the lubricant oil, or grease vehicle may be of any suitable lubricating viscosity range, as for example, from about 45 SUS at 100° F. to about 6,000 SUS at 100° F., and, preferably, from about 50 to about 250 SUS at 210° F. These oils may have viscosity indices from below zero to about 100 or higher. Viscosity indices from about 70 to about 95 are preferred. The average molecular weight of these oils may range from about 250 to about 800. Where the lubricant is to be employed in the form of a grease, the lubricating oil is generally employed in an amount sufficient to balance the total grease composition, after accounting for the desired quantity of the thickening agent and other additive components to be included in the grease formulation.

In instances where synthetic oil, or synthetic oils employed as the vehicle for the grease, are desired in preference to mineral oils, or in combination therewith, various compounds of this type may be successfully utilized. Typical synthetic vehicles include polyisobutylene, polybutenes, hydrogenated polydecenes, polypropylene glycol, polyethylene glycol, trimethylolpropane esters, neopentyl and pentaerythritol esters, di(2-ethylhexyl) sebacate, di(2-ethylhexyl) adipate, dibutyl phthalate, flurocarbons, silicate esters, silanes, esters of phosphorous-containing acids, liquid ureas, ferrocene derivatives, hydrogenated mineral oils, chain-type polyphenyls, siloxanes and silicones (polysiloxanes), alkyl-substituted diphenyl ethers typified by a butyl-substituted bis (p-phenoxy phenyl) ether, phenoxy phenylethers, etc.

Fully formulated lubricating oils may include a variety of additives (for their known purpose) such as dispersants, detergents, inhibitors, antiwear agents, antioxidants, friction modifiers, antifoams, pour depressants and other additives including phenates, sulfonates and zinc dithiophosphates.

As hereinbefore indicated, the aforementioned additive compounds may be incorporated as multifunctional agents in grease compositions. When high temperature stability is not a requirement of the finished grease, mineral oils having a viscosity of at least 40 SUS at 150° F., and particularly those falling within the range from about 60 SUS to about 6,000 SUS at 100° F. may be employed. The lubricating vehicles of the improved greases of the present invention, containing the above described additives, are combined with a grease forming quantity of a thickening agent. For this purpose, a wide variety of materials dispersed in the lubricating vehicle in grease-forming quantities in such degree as to impart to the resulting grease composition the desired consistency. Exemplary of the thickening agents that may be employed in the grease formulation are non-soap thickeners, such as surface-modified clays and silicas, aryl ureas, calcium complexes and similar materials. In general, grease thickeners may be employed which do not melt and dissolve when used at the required temperature within a particular environment; soap thickeners such as metallic (lithium or calcium) soaps including hydroxy stearate and/or stearate soaps can be used however, in all other respects, any material which is normally employed for thickening or gelling hydrocarbon fluids or forming greases can be used in preparing the aforementioned improved greases in accordance with the present invention.

Included among the preferred thickening agents are those containing at least a portion of alkali metal, alkaline earth metal or amine soaps of hydroxyl-containing fatty acids, fatty glycerides and fatty esters having from 12 to about 30 carbon atoms per molecule. The metals are typified by sodium, lithium, calcium and barium. Preferred is lithium. Preferred members among these acids and fatty materials are 12-hydroxystearic acid and glycerides containing 12-hydroxystearates, 14-hydroxystearic acid, 16-hydroxystearic acid and 6-hydroxystearic acid.

The reaction products are highly useful as multifunctional antioxidant/extreme pressure additives. They are added to the lubricating medium in amounts sufficient to impart such properties to the lubricant. More particularly, such properties will be imparted to the lubricant by adding from about 0.001% to about 10% by weight, preferably from about 0.01% to about 3%, of the neat product.

The examples which appear below demonstrate the efficacy of this invention. These examples are illustrative only and demonstrate the making of a reaction product of citric acid and oleyl alcohol.

EXAMPLE 1

Approximately 96.1 g, (0.50 mole) of citric acid, 136.9 gm (0.51 mole) oleyl alcohol and a catalytic amount of acid* were charged to a 1-liter reactor equipped with a condenser, Dean-Stark trap, thermometer, nitrogen purge, and a mechanical stirrer. The temperature was increased to 190° C. until 12 ml of water was removed. After cooling to <100° C. 100 ml of toluene was added, 1.0 additional ml of water was removed azeotropically. After removing volatile components by vacuum distillation 217 gm of a clear reddish-brown liquid was obtained.

* The acid used as a catalyst herein is selected from a member of the group consisting of phosphoric, phosphorous, hypophosphorous, hydrochloric, hydrofloric, hydrobromic, hydroiodic, sulfuric, sulfurous, p-toluenesulphonic, mesyl, brosyl and nitric.

EXAMPLE 2

Approximately 57.6 gm, (0.30 mole) of citric acid, 166 5 gm (0 62 mole) oleyl alcohol, 100 ml xylene*, and a catalytic amount of acid were charged to a 1-liter reactor equipped with a condenser, Dean-Stark trap, thermometer, nitrogen purge, and a mechanical stirrer. The temperature was refluxed at 175° C. until 9.8 ml of water was removed. After removing volatile components by vacuum distillation 211 gm of a clear light brown liquid was obtained.

* Xylene as used herein and in the other examples includes ortho-, meta-, and para-xylene and mixtures thereof. In addition to xylene, other non-polar solvents may be used such as toluene, linear or branched paraffins, and mixtures thereof.

EXAMPLE 3

Approximately 96.06 gm, (0.50 mole) of citric acid, 134.25 gm (0.50 mole) oleyl alcohol, 200 ml xylene, and a catalytic amount of acid were charged to a 1-liter reactor equipped with a condenser, Dean-Stark trap, thermometer, nitrogen purge, and a mechanical stirrer. The temperature was increased to 170° C. until 9 ml of water was removed. After removing volatile components by vacuum distillation a clear reddish-brown liquid was obtained. The product had a kinematic viscosity of 27.2 cSt at 100° C.

EXAMPLE 4

Approximately 96.06 gm, (0.50 mole) of citric acid, 268.5 gm (1.0 mole) oleyl alcohol, 100 ml xylene, and a catalytic amount of acid were charged to a 1-liter reactor equipped with a condenser, Dean-Stark trap, thermometer, nitrogen purge, and a mechanical stirrer. The temperature was increased to 180° C. until 18 ml of water was removed. After removing volatile components by vacuum distillation a clear yellowish-brown liquid was obtained. The product had a kinematic viscosity of 15.7 cSt at 100° C.

EXAMPLE 5

Approximately 96.06 gm, (0.50 mole) of citric acid, 402.75 gm (1.50 mole) oleyl alcohol, 100 ml xylene, and a catalytic amount of acid were charged to a 1-liter reactor equipped with a condenser, Dean-Stark trap, thermometer, nitrogen purge, and a mechanical stirrer. The temperature was increased to 190° C. until 27 ml of water was removed. After removing volatile components by vacuum distillation a clear light-brown liquid was obtained. The product had a kinematic viscosity of 11.23 cSt at 100° C.

EVALUATION OF THE PRODUCTS

The products of the above reactions were blended into fuels and evaluated for antiwear properties in a four-ball wear machine and a ball-on cylinder lubricity evaluator (BOCLE) at 10 Kg/600 rpm at 122° F. for 30 minutes and 3 Kg/240 rpm at 25° C. at 10% humidity, respectively.

The antiwear properties of the examples were evaluated using the Four Ball Wear Test as shown in Table 1. The results clearly exhibit the excellent antiwear properties inherent in these unique compositions.

In the Four Ball Wear Test three stationary balls are placed in a lubricant cup and a lubricant or fuel containing the compound to be tested is added thereto, and a fourth ball is placed in a chuck mounted on a device which can be used to spin the ball at known speeds and loads. The examples were tested using half inch balls of 52100 steel for thirty minutes under 10 Kg load at 600 rpm and 122° F. If additional information is desired consult test method ASTM D2266 and/or U.S. Pat. No. 4,761,482. This patent is hereby incorporated by reference herein.

TABLE 1

Four-Ball and BOCLE Wear Test

| Item | *K Factor | |
|---|---|---|
| | Four Ball | BOCLE |
| Low sulfur middle distillate base fuel | $29.1 \times 10^{-8}$ | $40 \times 10^{-8}$ |
| 0.1% Example 1 in base fuel | $0.7 \times 10^{-8}$ | $8 \times 10^{-8}$ |
| 0.1% Example 2 in base fuel | $2.2 \times 10^{-8}$ | — |

*K is the wear rate expressed as volume per unit load per unit sliding distance times hardness. K (as reported in Table 1) is the wear coefficient and is calculated from the wear volume, V, of the stationary ball.

In order to demonstrate the ability of a base fuel that contains the additive to resist wear under load, Cameron Plint data was obtained. As is demonstrated by this data shown in Table 2, the base fuel containing the additive showed less wear under load when a non-conducting film was in the geometrical contact area than did a distillate base fuel lacking the additive. The Cameron Plint machine is an oscillating-sliding machine to measure fretting wear. Use of Cameron Plint data is known to those skilled in the art. The data below show that the additive reduces wear and produces a non-conductive film on the surface.

TABLE 2

Cameron Plint Data

| Item | K Factor | % Film* |
|---|---|---|
| Low sulfur middle distillate base fuel | $7.7 \times 10^{-8}$ | 29 |

TABLE 2-continued

| Cameron Plint Data | | |
|---|---|---|
| Item | K Factor | % Film* |
| 0.1% Example 1 in base fuel | $1.4 \times 10^{-8}$ | 95 |
| 20 Newton load, 20 Hz, 15 mm oscillatory amplitude and 25° C., for 30 minutes. | | |

*% Film reflects the relative proportion of time that there is a non-conducting film in the geometrical contact area which develops during the test.

The products of the above reactions were blended into base oils and evaluated for friction modification in the Low Velocity Friction Apparatus (LVFA) at 58 psig, static coefficient of friction, and 250° F. A GM/LVFA can be purchased from Faville-LaValle Corp. located in Downers Grove, Ill. The percent reduction in friction values, as shown in Table 3 below, reflect the static values when the base oil is a mineral oil.

TABLE 3

| Low Velocity Friction Apparatus | |
|---|---|
| Item | % Friction Reduction |
| 0.1% Example 1 in a base oil | 68 |
| 0.1% Example 2 in a base oil | 25 |

The use of additive concentrations of alkylated citric acid adducts in fuels and/or lubricants have the potential to significantly reduce fuel pump, injector, and engine wear. They will also potentially improve fuel economy. These additives also have the potential to provide cleanliness, antioxidant, extreme pressure, antifatigue, and high temperature stabilizing properties. These additives may also have the potential to benefit fuel and lubricant properties by reducing hydrocarbon, carbon monoxide, and $NO_x$ emissions.

Obviously, many other variations and modifications of this invention as previously set forth may be made without departing from the spirit and scope of this invention as those skilled in the art readily understand. Such variations and modifications are considered part of this invention and within the purview and scope of the appended claims.

What is claimed is:

1. A composition comprising a major amount of an oil of lubricating viscosity or grease prepared therefrom and a minor multifunctional antioxidant/extreme pressure inhibiting amount of a product of reaction of;

(1) a citric acid having the generalized structure:

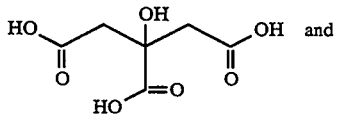

(2) an alkyl alcohol or an amine having the generalized structure nXRy where R is C1 to C200 hydrocarbyl or hydrocarbylene or a mixture thereof, and may optionally contain oxygen, nitrogen or sulfur, X is an amine, alcohol, thiol or a metal amide, alkoxide or thiolate, the metal is sodium, potassium, or calcium, and n is a number from 0.2 to 5.0.

2. The composition as recited in claim 1 wherein the oil of lubricating viscosity is selected from a member of the group consisting of (1) mineral oils, (2) synthetic oils, (3) vegetable oils, or (4) mixtures of mineral, vegetable, and synthetic oils or (5) is a grease prepared from any one of (1), (2) or (3) or (4).

3. The composition as recited in claim 1 wherein the product of reaction is obtained by a catalyst selected from a member of the group consisting of phosphoric, phosphorous, hypophosphorous, hydrochloric, hydrofloric, hydrobromic, hydroiodic, sulfuric, sulfurous, p-toluenesulphonic, mesyl, brosyl and nitric or mixtures thereof.

4. The composition as recited in claim 1 where the product of reaction is obtained by the addition of a xylene solvent.

5. The composition as recited in claim 1 wherein the product of reaction comprises alkylated citric acid adducts.

6. The composition as recited in claim 1 wherein the alcohol is oleyl alcohol.

7. The composition as recited in claim 1 wherein the product of reaction comprises alkylated citric acid adducts which additionally provide cleanliness, antifatigue, and high temperature stabilizing properties to lubricants and greases.

* * * * *